United States Patent [19]

Bamburg et al.

[11] 4,139,146

[45] Feb. 13, 1979

[54] SHIPPING CONTAINER

[75] Inventors: Robert A. Bamburg, Hebert; Farris N. Duncan, West Monroe; Roger M. Floyd, Monroe, all of La.

[73] Assignee: Olinkraft, Inc., West Monroe, La.

[21] Appl. No.: 885,842

[22] Filed: Mar. 13, 1978

[51] Int. Cl.[2] ..... B65D 5/22

[52] U.S. Cl. ..... 229/32; 229/35

[58] Field of Search ..... 229/35, 32, 33, 45

[56] References Cited

U.S. PATENT DOCUMENTS

| | | | |
|---|---|---|---|
| 2,089,694 | 8/1937 | Fallert | 229/33 |
| 2,333,244 | 11/1943 | Gordon | 229/35 X |
| 2,357,155 | 8/1944 | Williams et al. | 229/35 |
| 2,407,463 | 9/1946 | Williams | 229/35 X |
| 2,768,778 | 10/1956 | Ferguson et al. | 229/45 |
| 2,788,932 | 4/1957 | German, Jr. | 229/45 X |
| 3,342,401 | 9/1967 | Kitchell | 229/35 |
| 3,471,077 | 10/1969 | Kitchell | 229/35 X |
| 3,682,369 | 8/1972 | Isakson | 229/35 |
| 3,918,630 | 11/1975 | Meyers | 229/35 |
| 3,933,300 | 1/1976 | Dempster | 229/33 |

*Primary Examiner*—Davis T. Moorhead

*Attorney, Agent, or Firm*—Norvell E. Von Behren

[57] ABSTRACT

An improved shipping container having novel locking features in the end panel and corner flaps. The novel locking features improved bulge resistance at the end panels from sideward bulge of the product. The improved container comprises a pair of corner flaps being hinged from the side panels and folded inwardly against an end panel with the two corner flaps and end panel on each side of the container having a quadruple lock. The lock is formed by providing a locking tab on each corner flap as well as a pair of locking tabs on the end panel with the end panel and corner flaps locking tabs being designed to be swung and locked in the opening formed by the aligned mating locking tab.

3 Claims, 8 Drawing Figures

SHIPPING CONTAINER

BACKGROUND OF THE INVENTION

This invention relates generally to shipping containers, and more particularly, to an improved shipping container of the type that may be used in packaging poultry or other bulk materials whereby improved bulge resistance is desirable, as well as ease in setting up of the box in the packer's facilities.

In the setting up of containers in a packing facility, it is the custom to stock the production blanks in a flat, unfolded form, and then to set up the container from the blank. The container is then stapled at the end panels to the corner flaps or is provided with some single or double locked construction on to the end panels for ease in set up. In designing containers for such an operation, it is important to attempt to design sufficient strength into the container so that the packaged containers may be stacked one on top of each other in the ultimate consumer's plant without the lower containers being destroyed from the weight of the containers stacked above them. As a result, stacking strength becomes very important in such container design and especially at the ends of the container where stacking strength is mostly needed.

SUMMARY OF THE INVENTION

In order to overcome the problems inherent in the various designs of prior art containers and in order to provide a much improved shipping container, there has been provided by the subject invention an improved shipping container having much improved stacking strength resulting from an unbroken line along the top of each end panel as well as the side panels. In addition, the improved shipping container has a double wall thickness on the outer edges of the end panel to provide much improved stacking strength.

The improved container is obtained by providing a pair of corner flaps which are hinged to the side panels of the container and are folded inwardly against the end panel with the corner flaps and the end panel being cut to the same height, and with each corner flap having formed a locking tab which is positioned against a mating, locking tab on the end panel. The end panel locking tab is designed in the preferred embodiment to be rotated inwardly and downwardly while the locking tabs on the corner flaps are designed to be rotated outwardly and upwardly when locked in position. As a result, a quadruple lock is formed at each end of the container as a result of the four locking tabs formed and utilized on each end of the container. This quadruple lock at each end of the container provides improved bulge resistance whenever a bulk quantity of food products such as chickens are positioned in the container.

A prior art search in the U.S. Patent Office of similar shipping containers uncovered the following U.S. patents:

| Patent No. | Patentee | Issue Date |
|---|---|---|
| 2,120,470 | C. T. Patterson | June 14, 1938 |
| 3,342,401 | T. C. Kitchell | Sept. 19, 1967 |
| 3,507,441 | T. L. Wilcox, et al | April 21, 170 |
| 2,768,778 | W. C. Ferguson, et al | Oct. 30, 1956 |
| 2,660,363 | L. G. Trickett, Jr., et al | Nov. 24, 1953 |
| 374,886 | R. P. Brown | Dec. 13, 1887 |
| 3,471,077 | T. C. Kitchell | Oct. 7, 1969 |

-continued

| Patent No. | Patentee | Issue Date |
|---|---|---|
| 3,682,369 | Eugene H. Isakson | Aug. 3, 1972 |

These patents show various combinations of locking tab structures and combinations of the usual shipping containers, none of which are thought to be material to the applicants' overall new and novel combination. The teachings of each patent will now be briefly discussed in order to see the differences in applicants' design.

The U.S. Pat. No. 2,120,470 to Patterson teaches a fastening device for a corrugated box using tongue members which pass through gate means to lock the tongue member passing through the gate, the gate member is bent to one side to allow the tongue member to pass, and then it returns to its original position to bind the tongue between its edge and the adjacent edge of the wall. The U.S. Pat. No. 3,342,401 to Kitchell teaches the use of end flaps which are hingedly connected to the end panels and also teaches the use of singular locking tabs which are pushed outwardly from the inside of the box resulting in a single lock at each corner of the container.

The U.S. Pat. No. 2,768,778 to Ferguson, et al., teaches the use of locking tongues cut from the hand holes on the end walls of the container which are interlocked with the lid of the container. The U.S. Pat. No. 2,660,363 to Trickett, Jr., et al., teaches a container which is used as a liner for a more rigid container and utilizes a single trapezoidal shaped lock formed from a trapezoidal opening in the end walls of the container. The U.S. Pat. No. 374,886 to Brown teaches the use of single flap locks from the outside of the container to the inside of the container using vertical slits cut in the end panels.

The U.S. Pat. No. 3,471,077 to Kitchell teaches the use of a locking tongue used in combination with an extending tab formed in the handle opening for locking the end panels to the side flaps of the container to provide a single lock at each end of the container. The U.S. Pat. No. 3,682,369 to Isakson teaches the use of turndown tabs formed on the side flaps to interlock with the end panel to provide a double lock structure at each end of the container. The U.S. Pat. No. 3,507,441 to Wilcox, et al., teaches the use of hold-in flaps in matching slots in the container walls similar to that taught by the U.S. Pat. No. 374,886 to R. P. Brown.

Accordingly, it is an object and advantage of the invention to provide an improved shipping container having improved bulging characteristics which are obtained by means of a quadruple lock at each end of the container in combination with the corner flaps and the end panels of the container.

Another object and advantage of the invention is to provide an improved container having improved stacking strength whereby double-wall thickness is obtained in the outer portion of the end panels, and triple-wall thickness is obtained in the central portion of the end panels with the triple-wall thickness providing reinforcement on the handle holes of the container.

Still another object and advantage of the invention is to provide an improved container which may be set up quickly and easily in the field without using staples with the quick set-up to be accomplished by means of the new and novel quadruple locking tabs formed on the ends of the container.

These and other objects and advantages of the invention will become apparent from a review of the drawings accompanying this application, as well as a study of the preferred embodiment to be described more fully hereinafter.

DESCRIPTION OF THE PREFERRED EMBODIMENT

Figure 1:
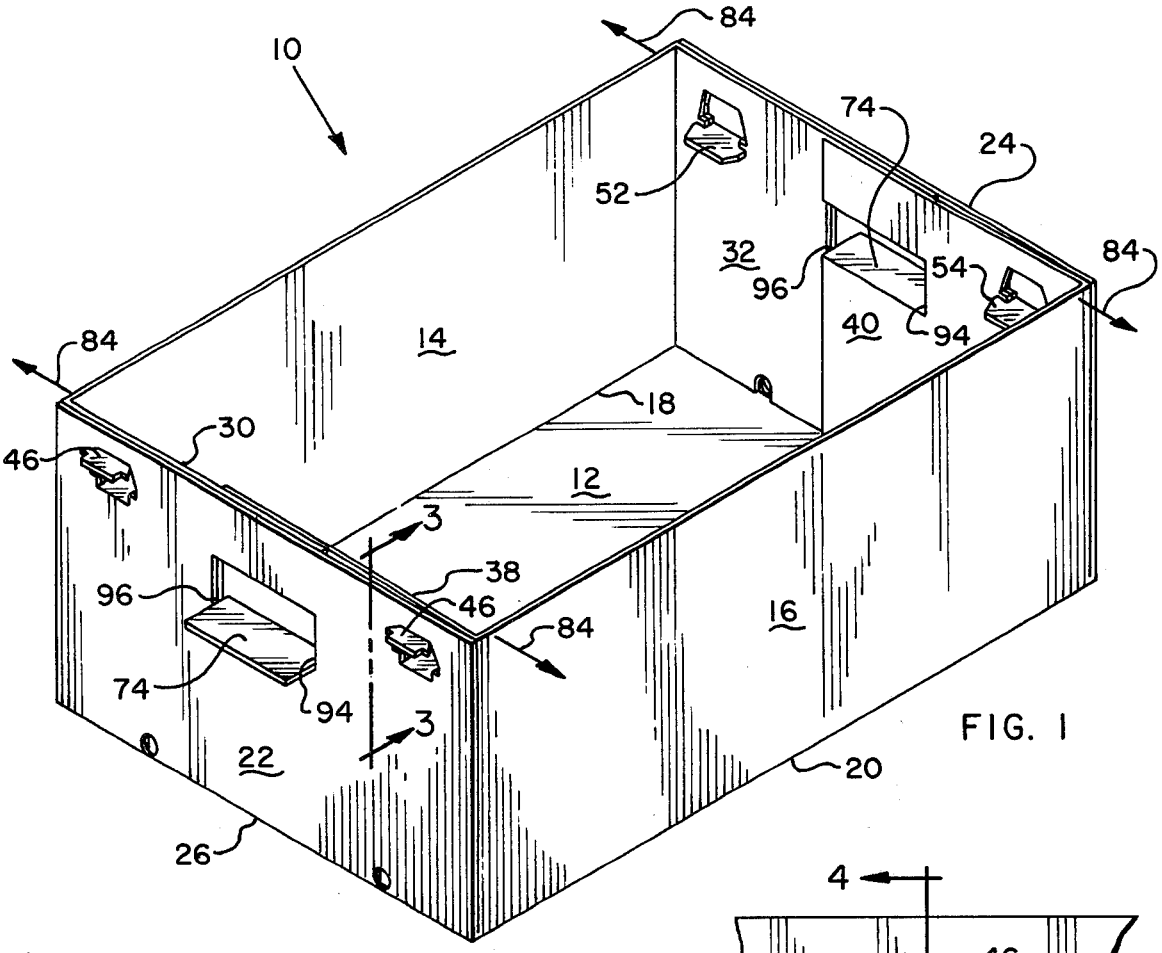
FIG. 1 is a perspective view of the subject new and novel shipping container showing the novel quadruple locking means on each end of the container.

Referring now to the drawings in general and in particular to FIG. 1 of the drawing there is shown the new and improved shipping container of the subject invention generally by the numeral 10 which comprises a bottom panel 12 having a pair of opposed side panels 14 and 16 hingedly attached to each other by means of the scoreline 18 and 20. A pair of opposed end panels 22 and 24 are hingedly attached to the bottom panel 12 by means of the scorelines 26 and 28. By referring to FIG. 2 of the drawing there can be seen the respective layouts of these various panels on the production blank of the subject invention and it can be seen that the side panel 14 has a pair of opposed corner flaps 30 and 32 hingedly attached to the side panel 14 by means of the scorelines 34 and 36 and in a like manner the side panel 16 has a pair of opposed corner flaps 38 and 40 hingedly attached to the side panel 16 by means of a pair of scorelines 42 and 44.

Figure 2:
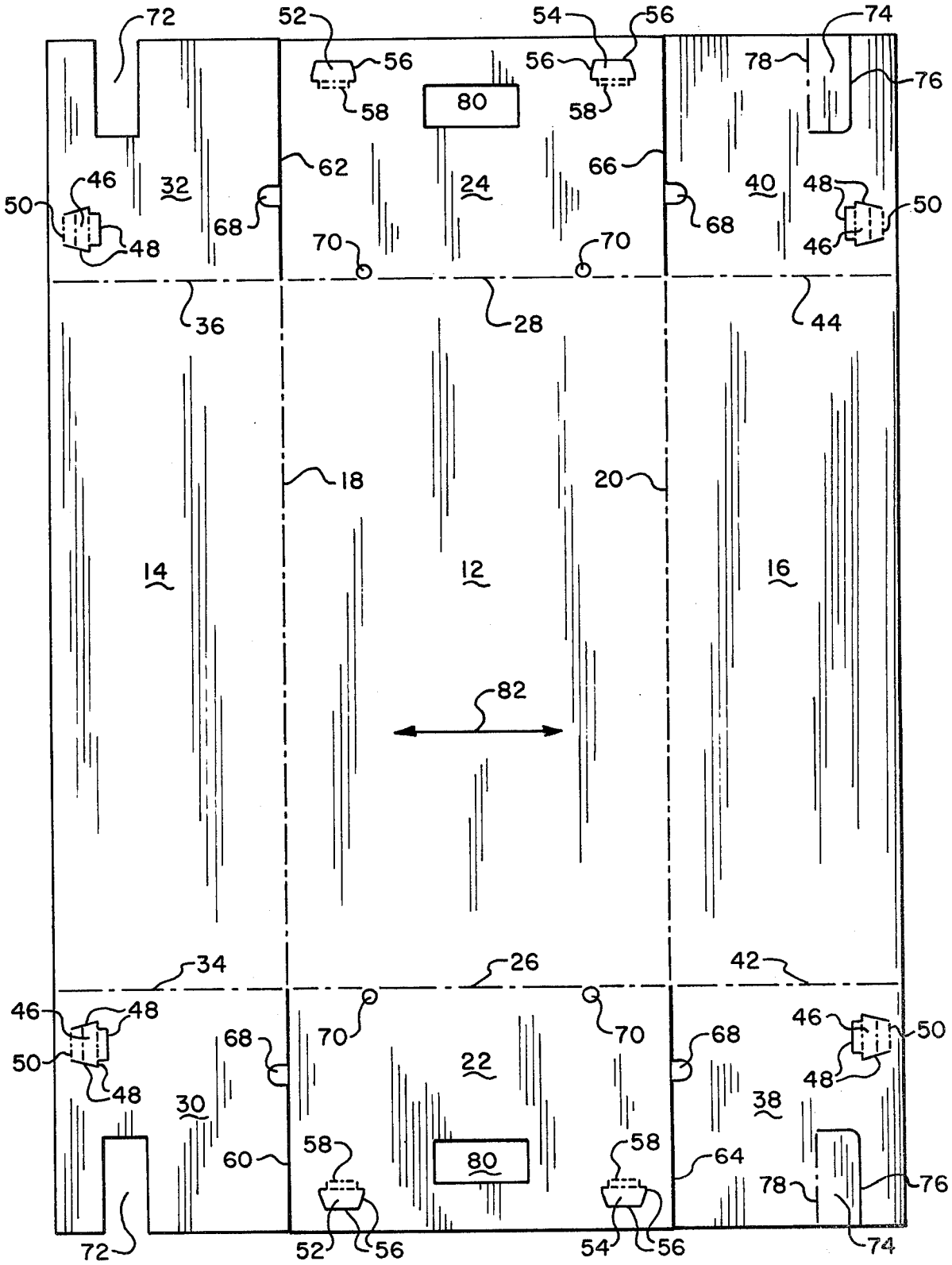
FIG. 2 is a plan view of a production blank of the subject container.

By referring to FIG. 1 of the drawing along with FIG. 2 it can be seen how in the preferred embodiment the corner flaps 30, 32, 38 and 40 are folded in relation to the end panels 22 and 24 in the preferred embodiment. The corner flaps are turned inwardly inside the container and are positioned against the end panel closest to said flaps. For example, it can be seen by referring to FIG. 1 that the corner flaps 30 and 38 are turned inwardly inside the container and are positioned against the end panel 22 with a portion of the corner flap 38 also being positioned against the corner flap 30. In a like manner the corner flaps 32 and 40 are turned inwardly inside the container and are positioned against the end panel 24 with a portion of the corner flap 40 also being positioned against the corner flap 32. In this manner, in the preferred embodiment, the quadruple locking means formed in the upper portion of the corner flaps and the end panels of the container is able to be functionally engaged as will be described hereinafter when referring to FIGS. 3 and 4 of the drawing.

By referring now to FIG. 2 of the drawing there will be described the formation of the quadruple locking means on the respective panels and flaps with the quadruple locking means comprising a series of locking tabs formed on the respective panels and flaps and being interlocked in the manner hereinafter described when referring to FIGS. 3 and 4 of the drawing. The corner flaps 30, 32, 38 and 40 have formed thereon in the position shown in FIG. 2, a locking tab 46 formed by a series of die cuts 48 and a scoreline 50. The locking tabs 46 of the preferred embodiment are formed in the general shape of a keystone as shown in FIG. 2 of the drawing but may be formed in other configurations within the spirit and scope of the invention. In a similar manner the end panels 22 and 24 have formed on the position shown in FIG. 2 of the drawing, at least two locking tabs 52 and 54 of the type similar to the locking tabs 46 formed on the corner flaps. The locking tabs 52 and 54 are also formed by means of a series of die cuts 56 and a scoreline 58 and may also be formed in the general shape of a keystone but of a somewhat different size than the keystone forming the locking tabs 46.

Figure 3:
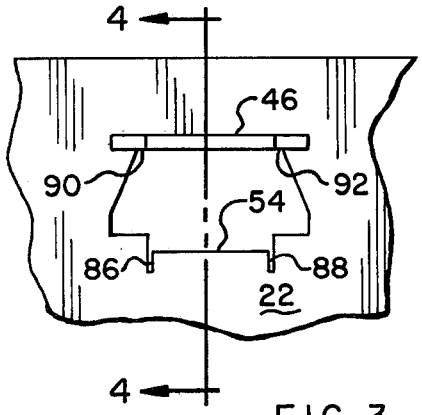
FIG. 3 is an enlarged view, taken along line 3—3 of FIG. 1, showing one of the improved locks of the subject container.
Figure 4:
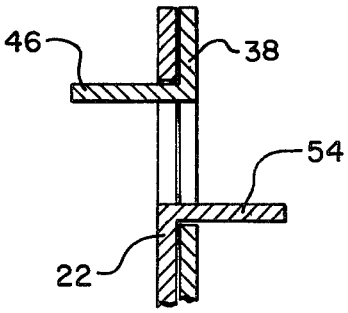
FIG. 4 is an enlarged sectional view, taken along line 4—4 of FIG. 3, showing the folding sequence in the preferred embodiment of the lock shown in FIG. 3.

By referring to FIG. 1 of the drawing it can be seen that whenever the respective corner flaps are folded against the end panels in setting up the box, the respective locking tabs 46 and 52 and 54 are designed and positioned in such a manner so that they will be able to interlock with each other as shown in FIG. 1 of the drawing and more specifically as shown in FIGS. 3 and 4.

Before describing in detail the actual positioning of the locking means and the respective locking tabs together, there will be described the remaining features of the production blank shown in FIG. 2 of the drawing in order to more fully understand the production setup and utilization of the novel container. As was beforementioned the corner flaps 30 and 32 are hingedly attached to the side panel 14 by means of the scorelines 34 and 36 and are also separated from the adjacent end panels 22 and 24 by means of the die cuts 60 and 62. In a similar manner the corner flaps 38 and 40 are separated from the adjacent end panels 22 and 24 by a series of die cuts 64 and 66. The corner flaps 30, 32, 38 and 40 have formed thereupon a drainage opening 68 in the position shown in the drawing FIG. 2 which is designed to mate with the drainage openings 70 formed in the end panels 22 and 24.

The corner flaps 30 and 32 have formed along one edge thereof, in the position shown in FIG. 2 of the drawing, a notch 72 while the corner flaps 38 and 40 have formed in a similar position a handle tab 74, formed by means of the die cut 76 in combination with the scoreline 78. The notches 72 and the handle tab 74 are designed to be aligned and positioned with the handle opening 80 formed in the end panels 22 and 24.

When aligned thusly, and as shown in FIG. 1 of the drawing, it can be seen how the handle tab 74 is folded outwardly in the preferred embodiment through the handle opening 80 and the handle notch 72. In constructing the improved container from the production blank shown in FIG. 2, the container as well as the production blank would preferably be formed from corrugated paperboard of the type well known in the art and would preferably have the flute direction running in the direction shown by the arrow 82 in the bottom panel 12 of the FIG. 2.

Referring now to FIGS. 3 and 4 of the drawing it will be seen how the quadruple locking means of the subject invention is achieved in order to provide the improved shipping container having the improved bulge resistance at the end panels from the sideward bulge of the products. By sideward bulge it is meant the bulge outwardly from the container side panels 14 and 16 as shown by the direction shown by the arrow 84 in FIG. 1 of the drawing. As a result of the outward side bulge in the container, the end panels are rigidly held in place by the quadruple locking means as more clearly shown in FIG. 3 of the drawing. The locking tabs 52 and 54, formed on the end panels 22 and 24, are designed for a downward and inward rotation into the central portion of the container while the locking tabs 46 formed on the corner flaps 30, 32, 38 and 40 are designed for an upward and outward rotation to the outside of the container. When the locking tabs are rotated thusly then each locking tab has a functioning bearing surface 86, 88, 90 and 92 to restrict the sideward motion shown by the arrow direction 84 caused by bulging of the products in the container. The bulge resistance is also aided by the use of the handle tabs 74 as shown in FIG. 1 of the drawing providing at least two more bearing surfaces 94 and 96 to resist bulge. From this it can be seen that a greatly improved bulge resistance is obtained for the particular package resulting from the formation of the novel quadruple locking means on the ends of the package.

Figure 5:
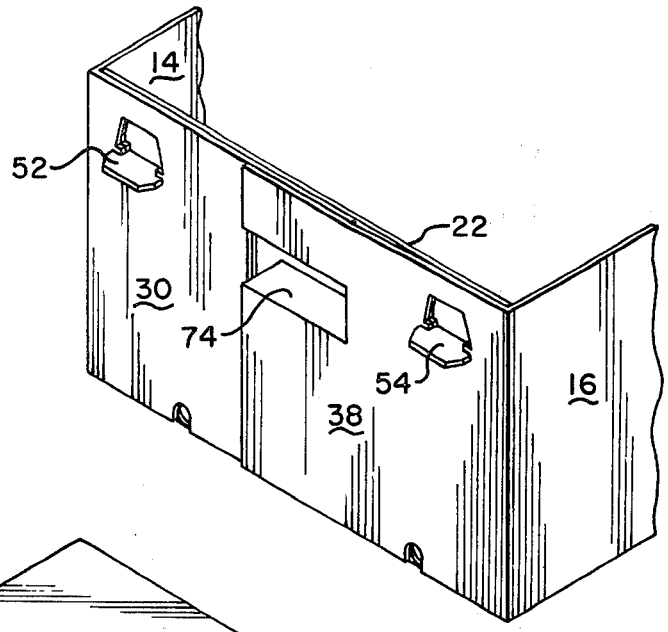
FIG. 5 is a perspective view similar to FIG. 1 showing a modification of the preferred embodiment wherein the end panels and corner flaps are folded in a different manner.

Referring now to FIG. 5 of the drawing there is shown a modification of the preferred embodiment wherein the folding of the corner flaps and the end panels on the ends of the container are reversed. For example, in FIG. 5 it can be seen how the end panel 22 is folded inwardly into the container 10 while the corner flaps 30 and 38 are folded against the end panel 22 with a portion of the corner flap 38 being folded also against a portion of the corner flap 30. In this manner the locking tabs 52 and 54 formed in the end panel 22 would be folded outwardly and downwardly as shown in the drawing while the locking tabs 46 formed on the corner flaps 30 and 38 would be folded inwardly and upwardly which is not shown in FIG. 5. In a like manner the handle tab 74 formed in the corner flap 38 would be folded inwardly and downwardly through the notch 72 and the handle opening 80 to complete the folding of the various tabs and panels.

When formed in this manner it can be seen that either one end or both ends of the container can be folded as shown in FIG. 5 or the ends can be folded as shown in FIG. 1 and also one end could be folded as shown in FIG. 1 and one end could be folded as shown in FIG. 5.

Figure 6:
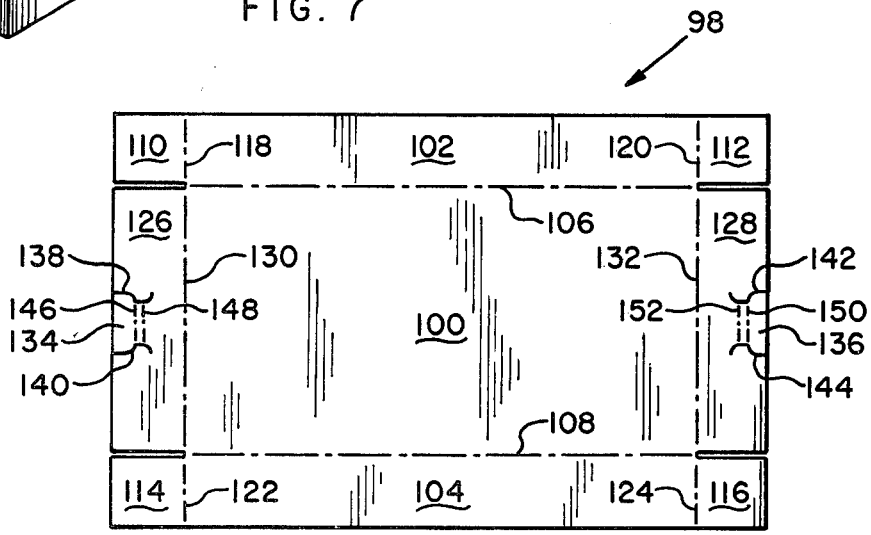
FIG. 6 is a plan view of the production blank for the top cap of the subject invention.

Referring now to FIG. 6 of the drawing there is shown a top cap or lid 98 which comprises a central panel 100 having formed on either side thereof, a plurality of side panels 102 and 104 by means of the scorelines 106 and 108. The side panels 102 and 104 have formed on each end thereof, a plurality of flaps 110, 112, 114 and 116 by means of the scorelines 118, 120, 122 and 124.

In a similar manner the central panel 100 has formed on the other sides thereof, a plurality of end panels 126 and 128 by means of the scorelines 130 and 132. The end panels 126 and 128 have formed in the central portion thereof a handle tab 134 and 136 formed by means of a plurality of die cuts 138, 140, 142 and 144 in combination with a plurality of scorelines 146, 148, 150 and 152.

Figure 7:
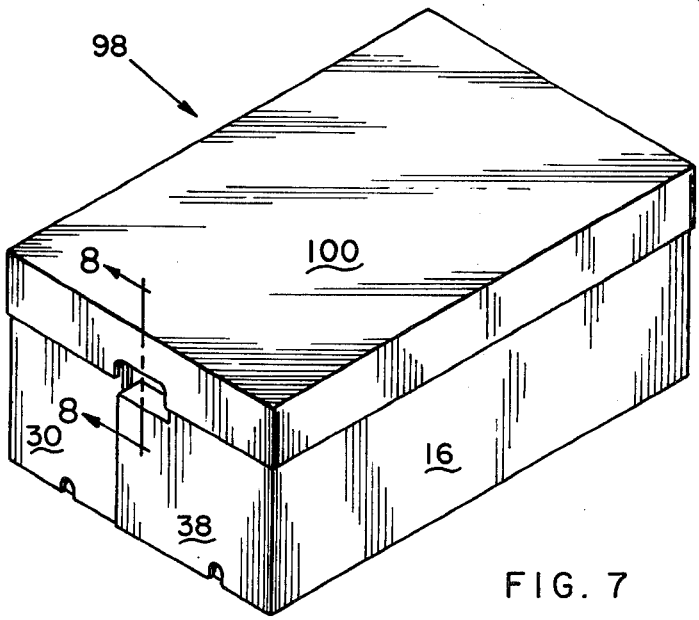
FIG. 7 is a partial perspective view of the top cap of FIG. 6 shown applied to the improved container of the type shown in FIG. 1 or FIG. 5

By referring to FIG. 7 of the drawing there is shown the top cap or lid 98 positioned on the modified version of the container shown in FIG. 5 and it is within the spirit and scope of the invention that the top cap or lid 98 would also be utilized with the preferred embodiment of the container as shown in FIG. 1 of the drawing. Whenever the top cap or the lid 98 is erected from the position shown in FIG. 6 of the drawing, the flaps 110, 112, 114 and 116 are folded about their respective scorelines 118, 120, 122 and 124. Thereupon the side panels 102 and 104 are folded about their respective scorelines 106 and 108 and in a like manner the end panels 126 and 128 are folded about their respective scorelines 130 and 132. When folded thusly the flaps 110 and 114 are positioned against the end panel 126 with the flaps 112 and 116 being positioned against the end panel 128 and being held thereto either by means of glue or staples.

Thereupon the top cap or lid 98 is positioned over the open end of the container 10 with the handle tabs 134 and 136 being bent about their respective scorelines 146, 148, 150 and 152. The handle tabs 134 and 136 are then positioned through the notches 72 and the handle openings 80 and are bent towards the interior of the container.

Figure 8:
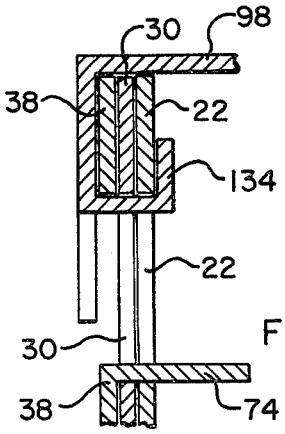
FIG. 8 is a partial sectional view taken along line 8—8 of FIG. 7 showing the locking of the top cap to the container.

By referring to FIG. 8 of the drawing there can be seen a partial sectional view taken along line 8—8 of FIG. 7 which shows the before described condition wherein the handle tabs 134 and 136 are folded inwardly. When folded in this manner it can be seen that the handle tabs 134 and 136 provide additional support to the end structure to resist the outer bulging of the side panels 14 and 16 as shown by the arrow directions 84. As has been mentioned before the top cap or lid 98 having the handle tabs 134 and 136 formed therein may be utilized also with the preferred embodiment of the invention as shown in FIG. 1 of the drawing and the inwardly folding of the handle tabs 134 and 136 would be similar to the folded position shown in FIG. 8 of the drawing with the only change being that the various end panels 22 and 24 as well as the various corner flaps 30, 32, 38 and 40 would be positioned differently according to which version of the invention was being utilized.

From the foregoing it can be seen that there has been provided by the subject invention a new and improved shipping container having novel locking features in the end panel and corner flaps which provide much improved bulge resistance from sideward bulges of the product packaged within the container. It may become apparent from reviewing the drawings and from a reading of the specification that many changes and modifications may be made in the basic invention within the spirit and scope of the invention and the preferred embodiment and modifications herein described have been given by way of illustration only.

Having described our invention, we claim:

1. An improved container having an open top and a pair of ends and comprising:

(a) a bottom panel;

(b) a pair of opposed side panels hinged to said bottom panel;

(c) a pair of opposed end panels hinged to said bottom panel;

(d) a pair of corner flaps hinged to opposed sides of said pair of opposed side panels and turned inwardly inside the container and positioned against the end panel closest to said flaps; and (e) quadruple locking means on each end of the container, said locking means comprising a locking tab formed on each of the corner flaps and at least two locking tabs formed on the end panel adjacent the corner flaps, the locking tabs formed on the end panel being designed for a downward and inward rotation into the central portion of the container and the locking tabs formed on the corner flaps being designed for an upward and outward rotation to the outside of the container, said quadruple locking means serving to tightly lock said flaps and said end panel together to provide a double wall end to the container along a portion of the end and a triple wall end along the remaining portion of the end.

2. An improved container having an open top and a pair of ends and comprising:

(a) a bottom panel;

(b) a pair of opposed side panels hinged to said bottom panel;

(c) a pair of opposed end panels hinged to said bottom panel;

(d) a pair of corner flaps hinged to opposed sides of said pair of opposed side panels and turned inwardly inside the container and positioned against the end panel closest to said flaps; and (e) quadruple locking means on each end of the container, said locking means comprising a locking tab formed on each of the corner flaps and at least two locking tabs formed on the end panel adjacent the corner flaps, the locking tabs formed on the end panel being designed for an upward and inward rotation into the central portion of the container and the locking tabs formed on the corner flaps being designed for a downward and outward rotation to the outside of the container, said quadruple locking means serving to tightly lock said flaps and said end panel together to provide a double wall end to the container along a portion of the end and a triple wall end along the remaining portion of the end.

3. An improved container having an open top and a pair of ends and comprising:

(a) a bottom panel;

(b) a pair of opposed side panels hinged to said bottom panel;

(c) a pair of opposed end panels hinged to said bottom panel;

(d) a pair of corner flaps hinged to opposed sides of said pair of opposed side panels and turned inwardly inside the container and positioned against the end panel closest to said flaps; and (e) quadruple locking means on each end of the container, said locking means comprising a locking tab formed on each of the corner flaps and at least two locking tabs formed on the end panel adjacent the corner flaps, the locking tabs formed on the end panel being designed for an inward rotation into the central portion of the container and the locking tabs formed on the corner flaps being designed for an outward rotation to the outside of the container, said quadruple locking means serving to tightly lock said flaps and said end panel together to provide a double wall end to the container along a portion of the end and a triple wall end along the remaining portion of the end.

* * * * *